US011229271B2

(12) United States Patent
Durksz et al.

(10) Patent No.: US 11,229,271 B2
(45) Date of Patent: Jan. 25, 2022

(54) LOCKING MECHANISM WITH PUSH- AND PULL-TO-RELEASE FUNCTION AND DEVICE COMPRISING SUCH LOCKING MECHANISM

(71) Applicant: KONINKLIJKE PHILIPS N.V., Eindhoven (NL)

(72) Inventors: Hedzer Durksz, De Knipe (NL); Sint Baron, De Knipe (NL); Gert Heerema, Groningen (NL); Johan Bernard Kuperus, Borger (NL); Krijn Maltha, Dokkum (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 437 days.

(21) Appl. No.: 16/322,554

(22) PCT Filed: Aug. 8, 2017

(86) PCT No.: PCT/EP2017/070025
§ 371 (c)(1),
(2) Date: Feb. 1, 2019

(87) PCT Pub. No.: WO2018/029173
PCT Pub. Date: Feb. 15, 2018

(65) Prior Publication Data

US 2019/0166970 A1 Jun. 6, 2019

(30) Foreign Application Priority Data

Aug. 9, 2016 (EP) ..... EP16183427

(51) Int. Cl.
*H01H 13/56* (2006.01)
*A45D 27/29* (2006.01)
*E05C 19/02* (2006.01)

(52) U.S. Cl.
CPC ..... *A45D 27/29* (2013.01); *E05C 19/022* (2013.01); *H01H 13/562* (2013.01)

(58) Field of Classification Search
CPC .... A45D 27/29; E05C 19/022; H01H 13/562; H01H 13/20; H01H 13/30; H01H 13/14;
(Continued)

(56) References Cited

U.S. PATENT DOCUMENTS 5,184,908 A 2/1993 Yamamoto
6,263,890 B1 7/2001 Hoser
(Continued)
7,002,091 B2 2/2006 Hoser
7,398,786 B2 7/2008 Eichhorn

FOREIGN PATENT DOCUMENTS

JP 2003223269 A 8/2003
JP 2008279143 A 11/2008

OTHER PUBLICATIONS

Video Showing a Conventional Pen Click Mechanism: https://www.youtube.com/watch?v=C-mu07uhQw.

*Primary Examiner* — Ahmed M Saeed

(57) ABSTRACT

The present invention relates to a locking mechanism (13) comprising a first locking member (11), a second locking member (12), and a biasing member (14) exerting, during operation, a biasing force (FB) on at least the first locking member (11) or the second locking member (12) in a biasing direction (B). The locking mechanism further comprises a guiding structure (32) for mutually guiding the first and second locking members (11, 12), wherein the first locking member (11) comprises a track structure (15) and the second locking member (12) comprises a guided element (16) guided by the track structure (15). The locking mechanism (13) is moved from an un-locked to a locked condition by applying a pushing force to at least one of the first and second locking members (11, 12). The locking mechanism (13) can be moved from the locked to the un-locked condition by applying either a pushing or a pulling force to at
(Continued)

least one of the first and second locking members (11, 12). The invention further relates to a device comprising such a locking mechanism (13). Such a device may be a holding device (40) for a shaving apparatus (24), for example a cleaning device for cleaning a shaving head (26) of a shaving apparatus (24).

15 Claims, 8 Drawing Sheets

(58) Field of Classification Search
CPC .... H01H 13/564; H01H 13/183; H01H 13/26; H01H 13/60; H01H 13/12; H01H 13/50; H01H 13/02; H01H 13/52
See application file for complete search history.

(56) References Cited

U.S. PATENT DOCUMENTS

| | | | | |
|---|---|---|---|---|
| 2002/0053503 | A1* | 5/2002 | Wang | H01H 13/562 200/524 |
| 2003/0139077 | A1 | 7/2003 | Sasaki | |
| 2005/0189207 | A1 | 9/2005 | Hoser | |
| 2008/0251366 | A1* | 10/2008 | Geppert | H01H 13/562 200/524 |
| 2011/0284353 | A1* | 11/2011 | Miwa | H01H 13/60 200/345 |
| 2013/0070415 | A1 | 3/2013 | Terry | |
| 2013/0310750 | A1 | 11/2013 | Hopman | |
| 2015/0107980 | A1* | 4/2015 | Taniguchi | H01H 13/26 200/524 |
| 2018/0096802 | A1* | 4/2018 | Lau | H01H 3/20 |

* cited by examiner

LOCKING MECHANISM WITH PUSH- AND PULL-TO-RELEASE FUNCTION AND DEVICE COMPRISING SUCH LOCKING MECHANISM

This application is the U.S. National Phase application under 35 U.S.C. § 371 of International Application No. PCT/EP2017/070025, filed on Aug. 8, 2017, which claims the benefit of International Application No. 16183427.0 filed on Aug. 9, 2016. These applications are hereby incorporated by reference herein.

FIELD OF THE INVENTION

The present invention relates to a locking mechanism comprising a first locking member, a second locking member, a biasing member exerting a biasing force on at least the first locking member or the second locking member in a biasing direction, and a guiding structure for mutually guiding the first and second locking members such that the first and second locking members are mutually displaceable with at least a displacement component parallel to the biasing direction, wherein the first locking member comprises a track structure and the second locking member comprises a guided element guided by the track structure, wherein the track structure comprises:

- a first track portion extending between a first track position and a second track position which are at a mutual distance relative to the biasing direction,
- a second track portion extending between the second track position and a third track position, said third track position being located between the first track position and the second track position relative to the biasing direction,
- a third track portion extending between the third track position and a fourth track position, said third track position being located between the first track position and the fourth track position relative to the biasing direction, and
- a fourth track portion extending between the fourth track position and the first track position, the first track position and the fourth track position being at a mutual distance relative to the biasing direction.

With such a locking mechanism, in an un-locked condition of the locking mechanism, the guided element is positioned in the first track position. To lock the locking mechanism, the guided element and the track structure are mutually displaceable such that the guided element is displaced from the first track position to the third track position by a first displacement via the first track portion against action of the biasing force and by a subsequent second displacement via the second track portion under influence of the biasing force. In a locked condition of the locking mechanism, the guided element is positioned in the third track position and rests against a supporting surface of the track structure under influence of the biasing force. To un-lock the locking mechanism, the guided element and the track structure are mutually displaceable such that the guided element is displaced from the third track position to the first track position by a third displacement via the third track portion against action of the biasing force and by a subsequent fourth displacement via the fourth track portion under influence of the biasing force.

The invention further relates to a device comprising such a locking mechanism. Such a device may e.g. be a cleaning device for a shaving head of a shaving apparatus.

BACKGROUND OF THE INVENTION

Locking mechanisms of the type mentioned in the opening paragraph are generally used for temporarily preventing two components from mutual displacement, and are used in a large number of applications. A well-known application is a writing-pen click mechanism. Another known application is in cleaning devices for electric shavers, comprising a cleaning basin into which the shaving head of the shaver can be placed in order to perform a cleaning operation on the shaving head. Such a cleaning device is known from U.S. Pat. No. 7,002,091. The known cleaning device comprises an upwardly extending contact member which is vertically movable, against the action of the biasing force of the biasing member of the locking mechanism incorporated in the cleaning device, relative to a main housing comprising the cleaning basin. To clean the shaver, the shaver has to be placed in an upright position, with the shaving head being placed in the cleaning basin. Subsequently, the user has to move the contact member in a vertical downward direction by applying a pushing force on the contact member, against the action of the biasing force, until the contact member contacts the tip portion of the body of the shaver. At this moment, the locking mechanism reaches its locked condition, so that the shaver is locked in the cleaning device by the contact member. In order to un-lock the shaver again, so that the shaver can be removed from the cleaning device after cleaning, the user has to exert again a pushing force in the downward direction on the movable contact member, against the action of the biasing force, until the guided element of the locking mechanism reaches the fourth track position. After that, the movable contact member is pushed upwardly into the un-locked condition under the influence of the biasing force, so that the shaver is released.

It has turned out that some users find it confusing that, to un-lock the cleaning device, the movable contact member has to be pushed down in the same direction as to lock the device cleaning. In an attempt to un-lock the cleaning device, some users intuitively exert a pulling force in an upward direction on the movable contact member. Thereby, the locking mechanism will at best not be un-locked, and at worst it will become damaged.

The inventors of the present invention have appreciated that an improved locking mechanism, which avoids the above mentioned user confusion, would be of benefit, and have in consequence devised the present invention.

SUMMARY OF THE INVENTION

It would be advantageous to achieve a locking mechanism of the type mentioned in the opening paragraph, which is more resistant to damage during use. It would also be desirable to obtain a locking mechanism of the type mentioned in the opening paragraph which can be more intuitively used. To achieve such an improved locking mechanism, it is intended to provide a locking mechanism which provides the user a choice in the mode of operation. In particular, it is intended to provide a locking mechanism of the type mentioned in the opening paragraph which can be un-locked by the application of any of a pushing force, i.e. a force against the action of the biasing force as is known from the prior art locking mechanism, or a pulling force in the opposite direction of the pushing force. In general, the invention preferably seeks to mitigate, alleviate or eliminate one or more of the above mentioned disadvantages singly or in any combination.

The above mentioned objects of the invention are achieved by a locking mechanism according to the invention, comprising a first locking member, a second locking member, a biasing member exerting, during operation, a biasing force on at least the first locking member or the second locking member in a biasing direction, and a guiding structure for mutually guiding the first and second locking members such that the first and second locking members are mutually displaceable with at least a displacement component parallel to the biasing direction, wherein the first locking member comprises a track structure and the second locking member comprises a guided element guided by the track structure, wherein the track structure comprises:

a first track portion extending between a first track position and a second track position which are at a mutual distance relative to the biasing direction, a second track portion extending between the second track position and a third track position, said third track position being located between the first track position and the second track position relative to the biasing direction, a third track portion extending between the third track position and a fourth track position, said third track position being located between the first track position and the fourth track position relative to the biasing direction, and a fourth track portion extending between the fourth track position and the first track position, the first track position and the fourth track position being at a mutual distance relative to the biasing direction, wherein:

in an un-locked condition of the locking mechanism the guided element is positioned in the first track position, to lock the locking mechanism, the guided element and the track structure are mutually displaceable such that the guided element is displaced from the first track position to the third track position by a first displacement via the first track portion against action of the biasing force and by a subsequent second displacement via the second track portion under influence of the biasing force, in a locked condition of the locking mechanism, the guided element is positioned in the third track position and rests against a supporting surface of the track structure under influence of the biasing force, the biasing force determining a predefined contact force between the guided element and the supporting surface, to un-lock the locking mechanism, the guided element and the track structure are mutually displaceable such that the guided element is displaced from the third track position to the first track position by a third displacement via the third track portion against action of the biasing force and by a subsequent fourth displacement via the fourth track portion under influence of the biasing force, the clocking mechanism being further characterized in that:

the supporting surface is provided on a supporting member which is displaceable relative to the track structure from a first position to a second position, with at least a displacement component perpendicular to the biasing direction, against action of a further biasing force of a further biasing member, in the first position of the supporting member, with the guided element in the third track position, the guided element rests against the supporting surface under influence of the biasing force, in the second position of the supporting member the track structure has a fifth track portion, extending between the third track position and the first track position, via which the guided element is displaceable from the third track position to the first track position without any mutual displacement of the guided element and the track structure against action of the biasing force, to un-lock the locking member, and the further biasing force has a predefined value such that a displacement of the supporting member from the first position to the second position under influence of a contact force between the guided element and the supporting surface only occurs when said contact force exceeds said predefined contact force by a predefined threshold value.

By the invention as described above, it is obtained that the first and second locking members are mutually movable from the locked condition to the un-locked condition both by application of an external pushing force, i.e. an external force in a direction opposite to the biasing direction of the biasing member of the locking mechanism as is common to the locking mechanism known from the prior art, and by application of an external pulling force, i.e. an external force in a direction opposite to the direction of the pushing force. Because, in the locked condition of the locking mechanism, the guided element rests against the supporting surface of the track structure with a predefined contact force determined by the biasing force of the biasing member, and because a displacement of the supporting member from the first position to the second position under influence of the contact force between the guided element and the supporting surface only occurs when said contact force exceeds said predefined contact force by a predefined threshold value, it is ensured that the locking mechanism is kept in the locked condition when no external force is applied on either the first locking member or the second locking member. The locking mechanism according to the invention can be un-locked in the way as is known from the prior art locking mechanism, i.e. by exerting an external pushing force in a direction opposite to the biasing direction of the biasing member. Thereby, the guided element is displaced from the third track position back to the first track position via, subsequently, the third track portion (against the action of the biasing force) and the fourth track portion (under influence of the biasing force). However, when the user exerts an external pulling force in a direction opposite to the usual pushing force, i.e. a force in the biasing direction of the biasing member, the contact force between the guided element and the supporting surface of the locking mechanism will increase and, if the pulling force is sufficiently large, the contact force will exceed the predefined contact force by the threshold value, so that the supporting member of the locking mechanism will be displaced from its first position to its second position. Thereby, the supporting member releases the fifth track portion, so that the guided element is displaced directly from the third track position to the first track position, i.e. without any movement opposite to the biasing direction, under the influence of the biasing force of the biasing member supported by the pulling force of the user.

The actual magnitude of the pulling force to be applied for un-locking the locking mechanism and the duration for which it is to be applied will depend on the specific design of the several components of the locking mechanism, including for example the magnitude of the further biasing force of the further biasing member.

In the following description, the term "pushing force" will be generally used to indicate an external force on the locking mechanism with a main component in a direction opposite to the biasing direction of the biasing member, to un-lock the locking mechanism by a displacement of the guided element via the third and fourth portions, and the term "pulling force" will be generally used to indicate an external force on the locking mechanism with a main component in the biasing direction of the biasing member, to un-lock the locking mechanism by a displacement of the guided element via the fifth portion.

In a locking mechanism according to the present invention, a part of the first track section may overlap with a part of the fifth track section. Examples will be shown in the figures.

It is further to be understood that the general expression "an $x^{th}$ track position and a $y^{th}$ track position which are at a mutual distance relative to the biasing direction" is not limited to embodiments wherein the $x^{th}$ track position and the $y^{th}$ track position are arranged on a common line parallel to the biasing direction. Said expression merely indicates the presence of a distance between the $x^{th}$ track position and the $y^{th}$ track position in a direction parallel to the biasing direction, but does not exclude the presence of a further distance between the $x^{th}$ track position and the $y^{th}$ track position in any direction perpendicular to the biasing direction. Likewise, the general expression "a $z^{th}$ track position located between the $x^{th}$ track position and the $y^{th}$ track position relative to the biasing direction" is not limited to embodiments wherein the $z^{th}$ track position is located on a common line with the $x^{th}$ track position and the $y^{th}$ track position extending parallel to the biasing direction, and does not exclude the presence of distances between the $x^{th}$ track position, the $y^{th}$ track position and the $z^{th}$ track position in any direction perpendicular to the biasing direction.

In an embodiment of the locking member according to the invention, the supporting member is pivotally mounted in relation to the track structure and is pivotable from the first position to the second position against action of the further biasing force. Such a pivotal mounting provides a compact and easy-to-manufacture design of the locking mechanism, and provides a well-defined movement of the supporting member.

In such embodiments with a pivotally mounted supporting member, in the first position of the supporting member, the supporting surface may extend obliquely relative to the biasing direction.

Further, in embodiments with a pivotally mounted supporting member, the guided element may have a sloped surface by means of which, in the locked condition, the guided element rests against the supporting surface, said sloped surface extending obliquely relative to the biasing direction in the locked condition.

In these embodiments, the obliquely extending supporting surface and the sloped surface of the guided element facilitate the displacement of the supporting member from its first position to its second position under the influence of an external pulling force to release the fifth track portion in order to enable the guided element to be displaced via the fifth track portion. This will be described in further detail in relation to the different embodiments shown in the figures.

In embodiments with a pivotally mounted supporting member, a pivot axis of the supporting member may extend in an imaginary plane in which the first, second, third, fourth and fifth track portions extend. Alternatively, a pivot axis of the supporting member may extend perpendicularly to an imaginary plane in which the first, second, third, fourth and fifth track portions extend.

In a further embodiment of the locking member according to the invention, the supporting member and the further biasing member are integrally formed. Thereby, a simplified structure of the locking member is achieved with a reduced number of components. In a still further embodiment of the invention, the further biasing member may comprise a leaf spring, and the supporting member may be provided on an end portion of the leaf spring which is deflectable at least with a deflection component perpendicular to the biasing direction. Such a leaf spring may typically be made from metal. The leaf spring has been found by the inventors to provide a reliable functioning of the locking mechanism. In the locked condition of the locking mechanism with the guided element in the third track position, the leaf spring is deflected by the guided element under the influence of a sufficiently large pulling force exerted on the locking mechanism, so that the leaf spring releases the fifth track portion to enable the guided element to be displaced via the fifth track portion. In an embodiment with such a leaf spring, the supporting member may be integrally formed with the leaf spring. Thereby, the manufacturing process of the locking mechanism may be further simplified, and the reliable functioning of the locking mechanism is further ensured. Alternatively, the supporting member may mounted on the leaf spring as a separate component, e.g. by means of an adhesive.

In an embodiment wherein the supporting member is integrally formed with the end portion of the leaf spring, the leaf spring may have a main portion, which has a longitudinal extension with a main extension component parallel to the biasing direction, and the end portion of the leaf spring may protrude relative to the main portion in a direction perpendicular to an imaginary plane in which the first, second, third, fourth and fifth track portions extend, the supporting surface comprising a side surface of said end portion facing the third track position. In this embodiment, when the locking mechanism is un-locked by means of a pushing force, the guided element is displaced from the third track position to the fourth track position along and over the end portion of the leaf spring, and the guided element is displaced from the fourth track position to the first track position along the opposite side surface of the end portion facing away from the third track position, without any deformation of the leaf spring. When the locking mechanism is un-locked by means of a pulling force, the leaf spring is deflected by pressure of the guided element against the end portion of the leaf spring, so that the leaf spring releases the fifth track portion to enable the guided element to be displaced via the fifth track portion.

In an embodiment wherein the supporting member is integrally formed with the end portion of the leaf spring, in the first position of the supporting member the supporting surface may rest against an abutment member of the track structure under influence of the further biasing force, said abutment member being provided near the third track position. In this embodiment, a contact force between the supporting surface and said abutment member is determined by the further biasing force, and said contact force influences the magnitude of the pulling force required to deflect the leaf spring by pressure contact between the guided element and the supporting surface.

In an embodiment of the locking member according to the invention, the guiding structure has a stationary position, the first locking member is displaceable relative to the guiding structure with at least said displacement component parallel to the biasing direction, the biasing member acts the biasing force on the first locking member, and the guided element is provided on a carrier which is hingedly connected to the guiding structure. By providing the guided element on said carrier which is hingedly connected to the stationary guiding structure, the guided element can easily and reliably follow the track structure which is part of the displaceable first locking member.

The present invention further relates to a device comprising a locking mechanism according to the invention, a first stationary part and a second part which is displaceable relative to the first stationary part between an un-locked position and a locked position by means of the locking mechanism, said second part comprising an operating member by means of which a user can displace the second part relative to the first stationary part, wherein the first and second locking members of the locking mechanism are respectively connected to one of the first and second parts of the device, wherein said un-locked position is associated with the un-locked condition of the locking mechanism, and wherein said locked position is associated with the locked condition of the locking mechanism. Since the device comprises a locking mechanism according to the invention, a user can displace the second part from the locked position to the un-locked position either by exerting a pushing force on the operating member in a direction opposite to the biasing direction of the biasing member of the locking mechanism, or by exerting a pulling force on the operating member in the biasing direction. An example of such a device is a drawer which can be displaced from an open and un-locked position into a closed and locked position. To open the drawer, a user can either push or pull the drawer.

Another example of such a device is a holding device for a shaving apparatus wherein:

- the first stationary part is a stationary holder wherein the shaving apparatus can be accommodated in a stationary position,
- the second part comprises a contact member which is displaceable relative to the stationary holder and which is configured and arranged to contact an end portion of the shaving apparatus when the shaving apparatus is accommodated in the holder,
- said contact member being displaceable between a first position associated with the un-locked condition of the locking mechanism, in which the contact member is at a distance from the end portion of the shaving apparatus when the shaving apparatus is accommodated in the holder, and a second position associated with the locking condition of the locking mechanism, in which the contact member is in contact with the end portion of the shaving apparatus when the shaving apparatus is accommodated in the holder. After placing the shaving apparatus in the stationary holder, with the contact member in its first position, the user can e.g. manually displace the contact member from its first position to its second position into contact with the end portion of the shaving apparatus. When the contact member reaches its second position and contacts the end portion of the shaving apparatus, the locking mechanism reaches its locked condition, so that in the second position of the contact member the shaving apparatus is locked in the holding device by the contact member. The contact member may e.g. comprise an electrical connection, which is electrically connected to the shaving apparatus in the second position of the contact member, e.g. to charge a rechargeable battery of the shaving apparatus. To move the contact member from its second locked position back into its first un-locked position, so that the shaving apparatus can be removed from the holding device, a user can either exert a pushing force on the operating member in a direction opposite to the biasing direction of the biasing member of the locking mechanism, or exert a pulling force on the operating member in the biasing direction.

Such a holding device for a shaving apparatus may further comprise:

- a receptacle configured and arranged for accommodating a shaving head of the shaving apparatus when the shaving apparatus is accommodated in the holder,
- a container configured and arranged for holding a cleaning fluid, and
- a supply system configured and arranged for supplying the cleaning fluid from the container to the receptacle.

In general, the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the drawings, in which:

FIGS. 1*a*, 1*b*, 1*c* schematically show the overall functioning of a known locking mechanism, wherein FIG. 1*a* shows the known locking mechanism in an un-locked condition, FIG. 1*b* shows the known locking mechanism in a locked condition, and FIG. 1*c* is an enlarged view of the track structure of the known locking mechanism;

FIGS. 2*a*, 2*b*, 2*c*, 2*d* schematically show the mutual displacement of the guided element of the second locking member and the track structure of the first locking member in a locking mechanism according to the invention, wherein FIG. 2*a* shows the displacement of the guided element along the first and second track portions, FIG. 2*b* shows the displacement of the guided element along the third and fourth track portions, and FIGS. 2*c* and 2*d* show the displacement of the guided element along the fifth track portion;

FIGS. 4*a*, 4*b*, 4*c* schematically show the movements of the guided element and the supporting member of the first embodiment shown in FIG. 3, wherein FIG. 4*a* shows the supporting member in its first position and the guided element in the third track position, FIG. 4*b* shows the supporting member in its second position and the guided element moving along the supporting surface of the supporting member, and FIG. 4*c* shows the movement of the guided element along the fifth track portion with the supporting member in its second position;

FIGS. 6*a*, 6*b*, 6*c* schematically show the movements of the guided element and the supporting member of the second embodiment shown in FIG. 5, wherein FIG. 6*a* shows the supporting member in its first position and the guided element in the third track position, FIG. 6*b* shows the supporting member in its second position and the guided element moving along the supporting surface of the supporting member, and FIG. 6*c* shows the movement of the guided element along the fifth track portion with the supporting member in its second position;

FIGS. 11*a*, 11*b*, 11*c* schematically show the locking mechanism of the cleaning device as shown in FIGS. 9*a*, 9*b*, 9*c*, 9*d*, wherein FIG. 11*a* shows the locking mechanism in its locked condition, FIG. 11*b* shows the guided element moving along the fifth track portion to un-lock the locking mechanism, and FIG. 11*c* shows the locking mechanism in its un-locked condition;

FIGS. 15*a*, 15*b*, 15*c* show a further embodiment of the second part as shown in FIG. 12, wherein FIG. 15*a* shows a front view of the further embodiment of the second part with the locking mechanism in its locked condition, FIG. 15*b* shows a cross-sectional side view of the further embodiment of the second part with the locking mechanism in its locked condition, and FIG. 15*c* shows a cross-sectional side view of the second part of the contact member with the locking mechanism in its un-locked condition.

DETAILED DESCRIPTION OF THE EMBODIMENTS

Figure 1:
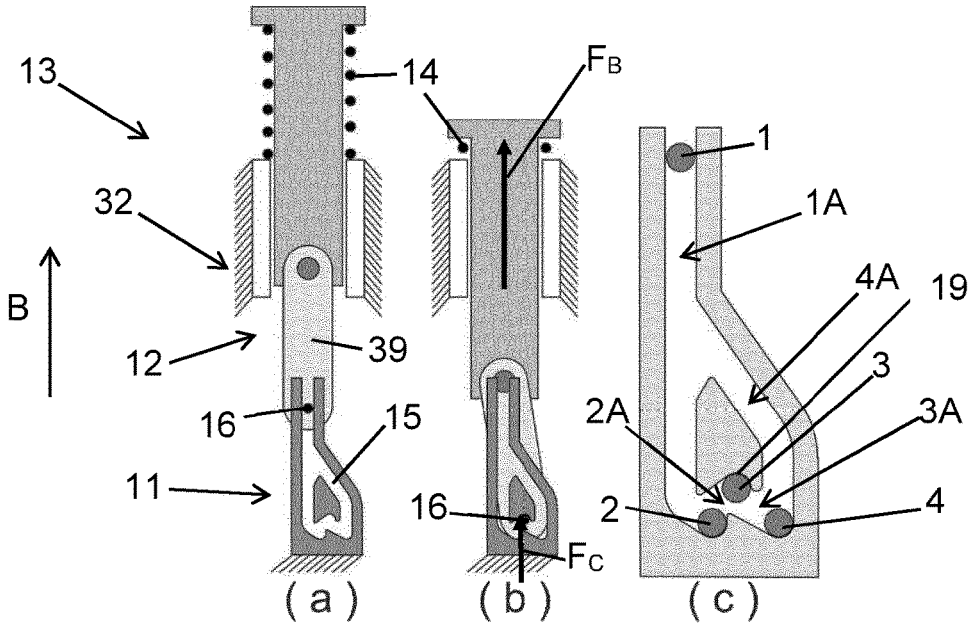

FIGS. 1*a*, 1*b*, 1*c* schematically show a known locking mechanism 13. It comprises a first locking member 11, a second locking member 12, and a biasing member 14 exerting, during operation, a biasing force $F_B$ on at least the first locking member 11 or the second locking member 12 in a biasing direction B. The biasing member 14 will typically be in the form of a spring which is compressed during operation of the locking member 13 whereby the biasing force $F_B$ is established. The locking mechanism 13 comprises a stationary guiding structure 32 for mutually guiding the first and second locking members 11,12 such that the first and second locking members 11,12 are mutually displaceable with at least a displacement component parallel to the biasing direction B. The first locking member 11 comprises a track structure 15 and the second locking member 12 comprises a guided element 16 guided by the track structure 15. FIG. 1*a* shows the locking mechanism 13 in an un-locked condition, and FIG. 1*b* shows the locking mechanism 13 in a locked position.

FIG. 1*c* is an enlarged view of the track structure 15 as shown in FIGS. 1*a* and 1*b*, showing different possible positions of the guided element 16 which may e.g. be in the form of a pin. The track structure 15 comprises a first track position 1, a second track position 2, a third track position 3, and a fourth track position 4. It further comprises a first track portion 1A extending between the first track position 1 and the second track position 2, a second track portion 2A extending between the second track position 2 and the third track position 3, a third track portion 3A extending between the third track position 3 and the fourth track position 4, and a fourth track portion 4A extending between the fourth track position 4 and the first track position 1. When the guided element 16 is in the first track position 1, the locking mechanism 13 is in an un-locked condition, and when the guided element 16 is in the third track position 3, the locking mechanism 13 is in a locked position.

As shown in FIG. 1*c*, the first track position 1 and the second track position 2 are at a mutual distance relative to the biasing direction B. The third track position 3 is located between the first track position 1 and the second track position 2 relative to the biasing direction B. In the embodiments described here, the track positions mentioned do not extend along a single imaginary line parallel to the biasing direction B. As shown, they are arranged with the third track position 3 being offset from an imaginary line between the first track position 1 and the second track position 2, and this imaginary line is not parallel to the biasing direction B. The third track position 3 is also located between the first track position 1 and the fourth track position 4 relative to the biasing direction B. The first track position 1 and the fourth track position 4 are at a mutual distance relative to the biasing direction B.

To lock the known locking mechanism 13, the user has to exert a pushing force in a direction opposite to the biasing direction B on the second locking member 12 in its un-locked condition as shown in FIG. 1*a*. Thereby, the guided element 16 is displaced from the first track position 1 to the third track position 3 via the first track portion 1A and the second track portion 2A. In the third track position 3, as shown in FIG. 1*b*, the guided element 16 rests against a supporting surface 19 of the track structure 15 under the influence of the biasing force $F_B$, so that the second locking member 12 is prevented from moving in the biasing direction B. To un-lock the known locking mechanism 13 from the locked condition as shown in FIG. 1*b*, the user has to again exert a pushing force in a direction opposite to the biasing direction B on the second locking member 12. Thereby, the guided element 16 is displaced from the third track position 3 to the fourth track position 4 via the third track portion 3A and, subsequently, from the fourth track position 4 back to the first track position 1 via the fourth track portion 4A under the influence of the biasing force B.

The locking mechanism 13 according to the invention as described here after is an improvement of the known locking mechanism as shown in FIGS. 1*a*, 1*b*, 1*c*, and comprises similar features of the known locking mechanism which will be identified in the following with similar reference numbers. In the example of FIGS. 1*a*, 1*b*, 1*c*, the first locking member 11 comprising the track structure 15 is in a stationary position relative to the guiding structure 32, and the second locking member 13 is displaceable relative to the first locking member 11, wherein the biasing force $F_B$ is exerted on the second locking member 13. The invention also covers embodiments of the locking mechanism wherein the second locking member 13 is in a stationary position, and the first locking member 11 comprising the track structure 15 is displaceable relative to the second locking member 13, wherein the biasing force $F_B$ is exerted on the first locking member 11.

FIGS. 2*a*, 2*b*, 2*c*, 2*d* schematically show the functioning of an embodiment of a locking mechanism 13 according to the present invention. In the illustrated embodiment, the mechanism is shown as being actuated by a user 17 applying an external force to an operating member 18 provided on an end portion of the movable second locking member 12.

However, other means of actuation are also covered by the scope of the present invention. In alternative embodiments wherein the first locking member is movable relative to a stationary second locking member, it will generally be the first locking member which will be actuated by the user. In FIGS. 2*a*, 2*b*, 2*c*, 2*d* and some of the following figures, the guided element 16 is the only illustrated part of the second locking member 12. This is for illustrative purposes only to make the figures more clear.

Figure 2:
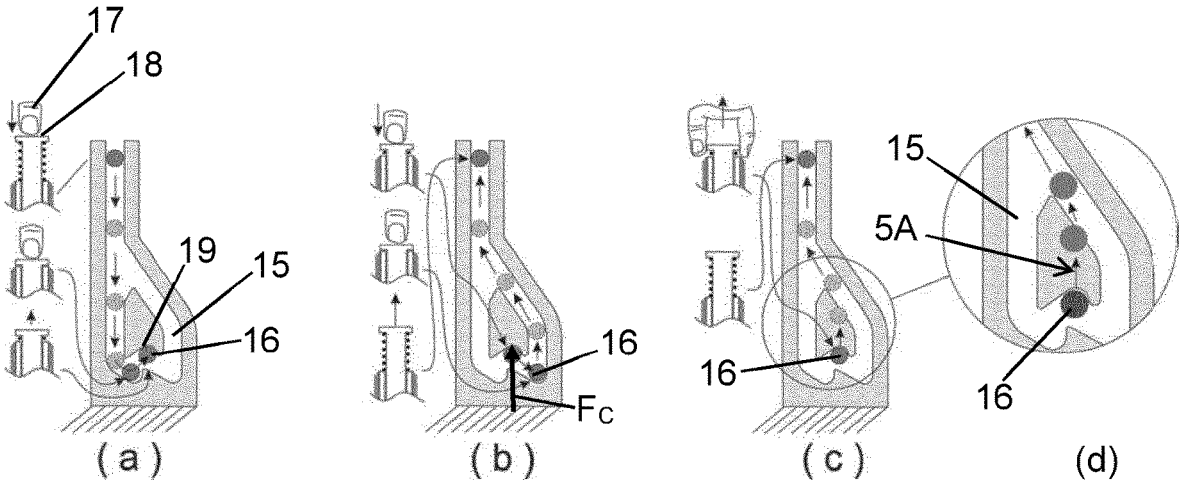

To lock the locking mechanism 13, the guided element 16 and the track structure 15 are mutually displaced such that the guided element 16 is displaced from the first track position 1 to the third track position 3 by a first displacement via the first track portion 1A against action of the biasing force $F_B$ (shown in FIG. 1*b*) and by a subsequent second displacement via the second track portion 2A under influence of the biasing force $F_B$. This locking action is shown in FIG. 2*a*, and to realize this locking action the user needs to apply an external pushing force in a direction opposite to the biasing direction B, like with the known locking mechanism. In the locked condition of the locking mechanism 13, shown in FIG. 2*b*, the guided element 16 is positioned in the third track position 3 and rests against a supporting surface 19 of the track structure 15 under influence of the biasing force $F_B$. The biasing force $F_B$ determines a predefined contact force $F_C$ (shown in FIG. 2*b*) between the guided element 16 and the supporting surface 19.

To un-lock the locking mechanism 13, the guided element 16 and the track structure 15 are mutually displaced such that the guided element 16 is displaced from the third track position 3 to the first track position 1 by a third displacement via the third track portion 3A against action of the biasing force $F_B$ and by a subsequent fourth displacement via the fourth track portion 4A under influence of the biasing force $F_B$. This un-locking action is schematically shown in FIG. 2*b*. This un-locking action is typically achieved by applying an external pushing force in the same direction as the pushing force applied to move the locking mechanism 13 from the un-locked to the locked condition as shown in FIG. 2*a*. This un-locking action of the locking mechanism 13 according to the present invention corresponds to the un-locking action of the known locking mechanism as shown in FIGS. 1*a*, 1*b*, 1*c*. As explained here before, some users of devices comprising the known locking mechanism find it confusing to apply a pushing force in the same direction for locking and un-locking. To un-lock the device, some users therefore intuitively try to apply a force in the opposite direction instead. With known locking mechanisms, such a force in the opposite direction typically does not un-lock the known locking mechanism, or even causes damage to the known locking mechanism.

FIG. 2*c* schematically shows the improvement provided by the present invention, in that the application of an external pulling force, i.e. a force in a direction opposite to the pushing force required to lock the locking mechanism 13, results in the guided element 16 following an alternative path directly from the third track position 3 to the first track position 1, i.e. without a displacement in a direction opposite to the biasing direction B, to change the locking mechanism 13 from its locked condition to its un-locked condition. FIG. 2*d* schematically shows an enlarged view of said alternative path, which is referred to as a fifth track portion 5A in the following.

Figure 3:
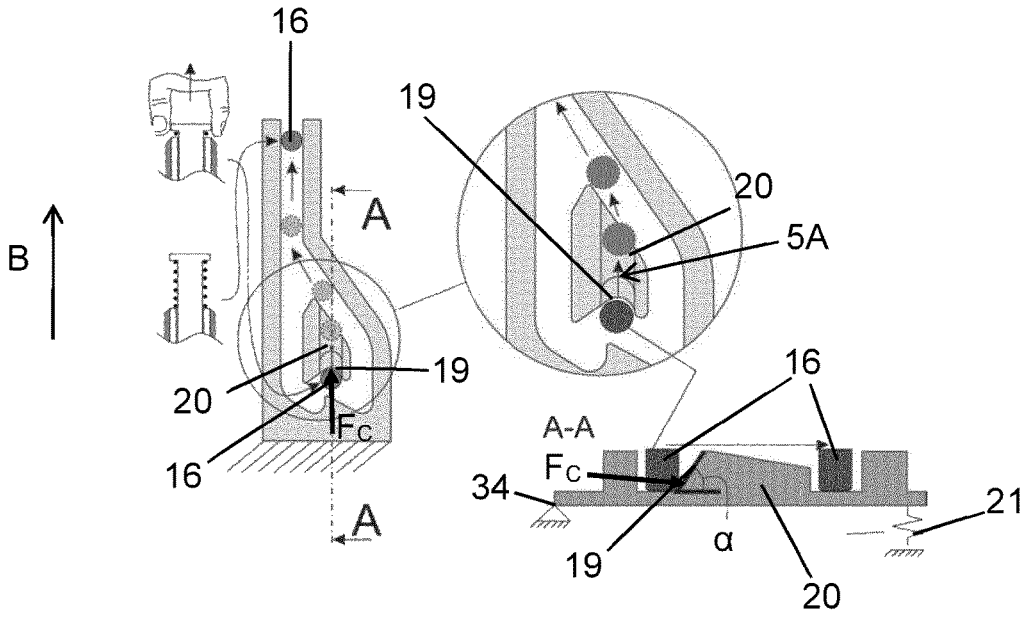
FIG. 3 schematically shows the functioning of a first embodiment of the locking mechanism according to the invention.
Figure 4:
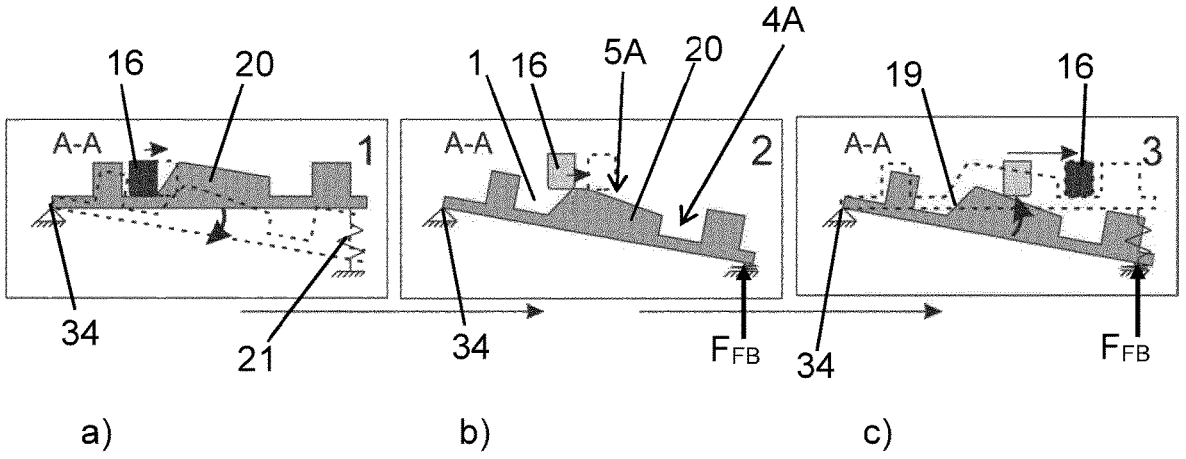
Figure 5:
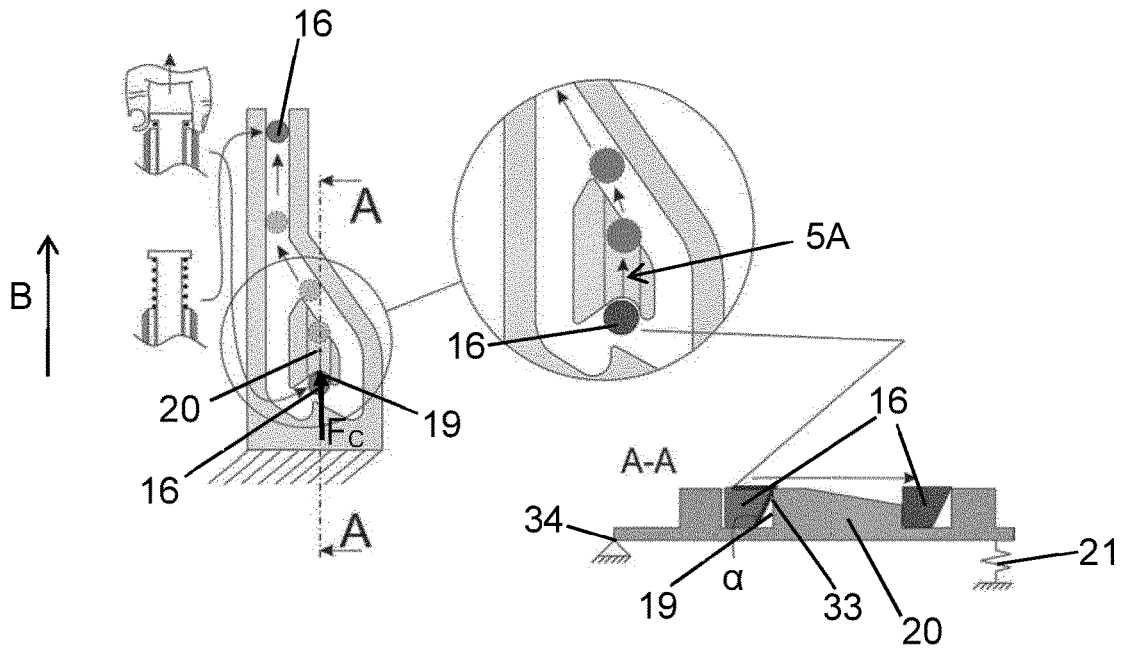
FIG. 5 schematically shows the functioning of a second embodiment of the locking mechanism according to the invention.

FIG. 3 shows a first embodiment of the locking mechanism according to the invention, in which the supporting surface 19 is provided on a supporting member 20 which is displaceable relative to the track structure 15 from a first position to a second position, with at least a displacement component perpendicular to the biasing direction B, against the action of a further biasing force $F_{FB}$ provided by a further biasing member 21. In the first embodiment, the supporting member 20 is pivotally mounted in relation to the track structure 15 and is pivotable from the first position to the second position against action of the further biasing force $F_{FB}$. In particular, the supporting member 20 is pivotable about a pivot axis 34 extending in an imaginary plane in which the first, second, third, fourth and fifth track portions 1A, 2A, 3A, 4A, 5A of the track structure 15 extend. The further biasing member 21 is in the form of a spring. In the first position of the supporting member 20, with the guided element 16 in the third track position 3 as shown in FIGS. 3 and 4*a*, the guided element 16 rests against the supporting surface 19 under the influence of the biasing force $F_B$. The biasing force $F_B$ is established by the compression of the biasing member 14 when the locking mechanism 13 is moved into the locked condition. The lower part of FIG. 3 shows an enlarged cross-sectional side view along the line A-A, from which it can be seen that, for this first embodiment, the supporting surface 19 extends obliquely by an angle $\alpha$ relative to the biasing direction B to facilitate the movement of the guided element 16 along the fifth track portion 5A as shown in more details in FIGS. 4*a*, 4*b*, 4*c*.

FIGS. 4*a*, 4*b*, 4*c* schematically show the establishment of the fifth track portion 5A, extending between the third track position 3 and the first track position 1, when the supporting member 20 is in the second position. FIGS. 4*a*, 4*b*, 4*c* are cross-sectional views along the line A-A in FIG. 3. FIG. 4*a* shows the supporting member 20 in its first position, and FIG. 4*b* shows the supporting member 20 in its second position. FIG. 4*c* schematically shows how the guided element 16 is displaceable from the third track position 3 towards the first track position 1 via the fifth track portion 5A, without any mutual displacement of the guided element 16 and the track structure 15 in a direction opposite to the biasing direction B. By this movement, the locking mechanism 13 is un-locked as shown in FIG. 3.

The further biasing force $F_{FB}$ has a predefined value such that a displacement of the supporting member 20 from its first position, shown in FIG. 4*a*, to its second position, shown in FIGS. 4*b* and 4*c*, under the influence of a contact force between the guided element 16 and the supporting surface 19 only occurs when said contact force exceeds said predefined contact force $F_C$ at least by a predefined threshold value. This predefined threshold value is determined by the further biasing force $F_{FB}$, the angle $\alpha$ of the sloped supporting surface 19, and the friction coefficient between the sloped supporting surface 19 and the guided element 16. To realize a contact force between the guided element 16 and the supporting surface 19 exceeding said predefined contact force by said predefined threshold value, a user has to apply an external pulling force on the second locking member 12 of the locking mechanism 13, i.e. an external force in a direction parallel to the biasing direction B and opposite to the direction of a pushing force required to lock the locking mechanism. The predefined threshold value ensures that the locking mechanism 13 according to the invention will maintain in its locked condition as shown in FIG. 4*a* when no external pulling force or only a small external pulling force is exerted.

In the embodiment shown in FIG. 3, the supporting member 20 is pivotally mounted in relation to the track structure 15 and is pivotable from the first position to the second position against the action of the further biasing force $F_{FB}$. In the first position of the supporting member 20, the supporting surface 19 extends obliquely relative to the biasing direction B. This oblique supporting surface 19 facilitates the mutual displacement of the guided element 16 and the supporting member 19 when un-locking the locking mechanism 13.

Figure 6:
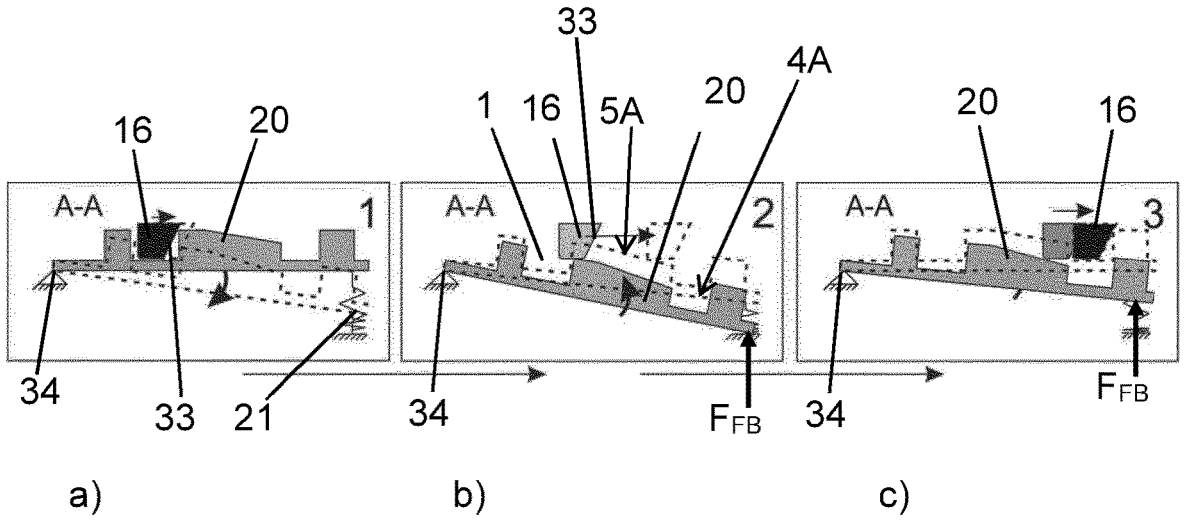

FIGS. 5 and 6*a*, 6*b*, 6*c* schematically show a second embodiment of the locking mechanism according to the invention resembling the first embodiment shown in FIG. 3, but wherein the guided element 16 has a sloped surface 33 by means of which, in the locked condition as shown in FIG. 6*a*, the guided element 16 rests against the supporting surface 19 of the supporting member 20. The sloped surface 33 extends obliquely, with an inclination angle $\alpha$, relative to the biasing direction B in the locked condition. This sloped surface 33 facilitates the mutual displacement of the guided element 16 and the supporting member 20 when the guided element moves from the third track position 3 to the first track position 1 along the fifth track portion 5A as shown in FIGS. 6*b* and 6*c*. FIGS. 6*a*, 6*b*, 6*c* are cross-sectional views along the line A-A in FIG. 5. Like in the first embodiment, in the second embodiment the supporting member 20 is pivotable from its first position (shown in FIG. 6*a*) to its second position (shown in FIGS. 6*b*, 6*c*) against the biasing force $F_{FB}$ of the further biasing element 21 about a pivot axis 34 extending in an imaginary plane in which the first, second, third, fourth and fifth track portions 1A, 2A, 3A, 4A, 5A of the track structure 15 extend. The functioning of the second embodiment is similar to the functioning of the first embodiment shown in FIG. 3. Yet another and not illustrated embodiment comprises both an oblique surface on the supporting member 20 and a sloped surface on the guided element 16.

Figure 7:
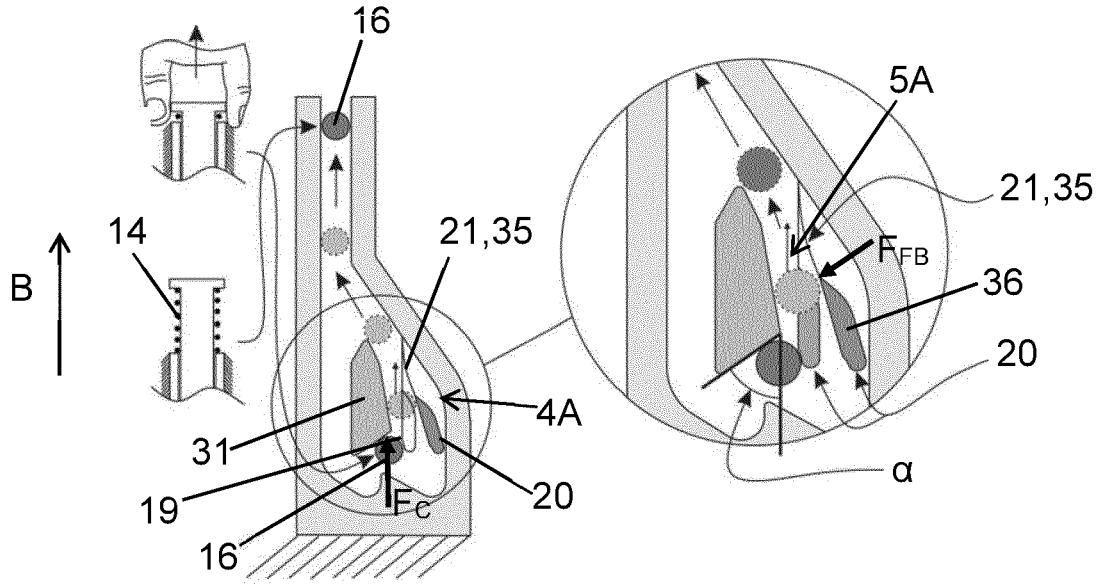
FIG. 7 schematically shows the functioning of a third embodiment of the locking mechanism according to the invention.

FIG. 7 schematically shows a third embodiment of the locking mechanism according to the invention, in which the supporting member 20 and the further biasing member 21 are integrally formed. In this third embodiment, the track structure 15 comprises an abutment member 31, and the further biasing member 21 comprises a leaf spring 35. The supporting member 20 is provided on an end portion 36 of the leaf spring 35. The leaf spring 35 is deflectable at least with a deflection component perpendicular to the biasing direction B. The supporting member 20 may be integrally formed with the leaf spring 35. Alternatively, the supporting member 20 and the leaf spring 35 are two separately manufactured parts which have been mutually jointed in the manufacturing process of the locking mechanism. In the locked condition of this third embodiment of the locking mechanism, the supporting member 20 rests against the abutment member 31 under the influence of the further biasing force $F_{FB}$ of the leaf spring 35, and the guided element 16 rests against the abutment member 31 and against the supporting surface 19 of the supporting member 20 under the influence of the biasing force $F_B$. When the user applies a pushing force on the second locking member 12 in the locked condition, the guided element 16 will be displaced from the third track position 3 to the fourth track position 4 and subsequently, under the influence of the biasing force $F_B$, from the fourth track position 4 to the first track position 1, without any displacement of the supporting member 20. When the user applies a sufficiently large pulling force on the second locking member 12 in the locked condition, the leaf spring 35 will be deflected under the influence of the increased contact force between the guided element 16 and the supporting surface 19, so that the supporting member 20 is displaced from its first position to its second position and the guided element 16 can move from the third track position 3 directly to the first track position 1 via the fifth track portion 5A to un-lock the locking mechanism.

Figure 8:
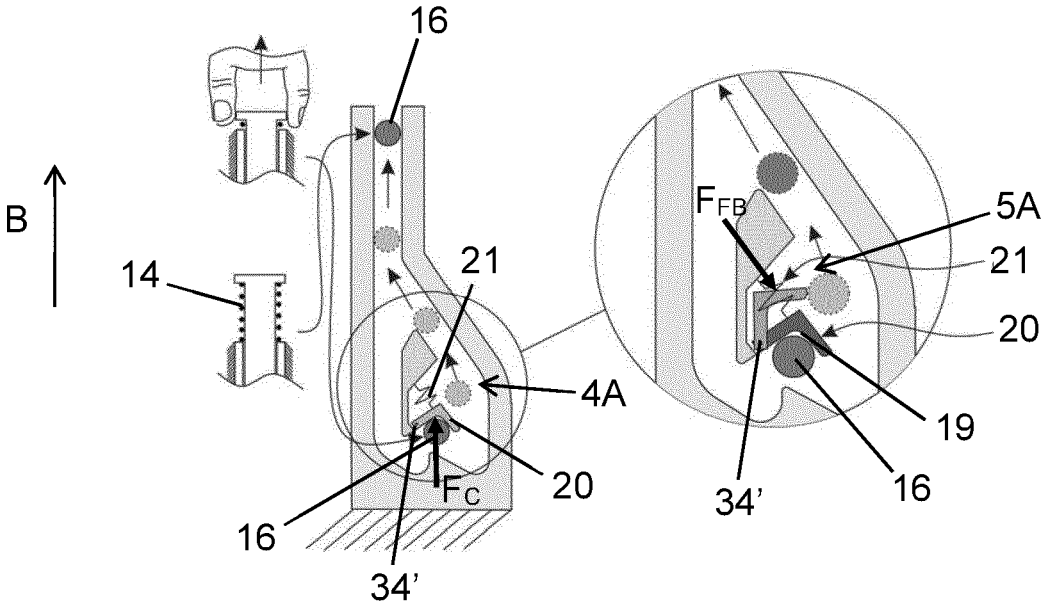
FIG. 8 schematically shows the functioning of a fourth embodiment of the locking mechanism according to the invention.

FIG. 8 shows a fourth embodiment of the locking mechanism according to the invention, in which the supporting member 20 is a V-shaped component which is pivotally mounted near an end portion, so that the supporting member 20 can perform a pivoting movement around a pivoting axis 34' from its first position to its second position to establish the fifth track portion 5A. In this fourth embodiment, the pivot axis 34' of the supporting member 20 extends perpendicularly to an imaginary plane in which the first, second, third, fourth and fifth track portions 1A, 2A, 3A, 4A, 5A of the track structure 15 extend. In the locked condition of this fourth embodiment of the locking mechanism, the supporting member 20 rests against an abutment member (not shown) under the influence of the further biasing force $F_{FB}$ of the further biasing member 21, and the guided element 16 rests against the supporting surface 19 of the supporting member 20 under the influence of the biasing force $F_B$ of the biasing member 14. When the user applies a pushing force on the second locking member 12 in the locked condition, the guided element 16 will be displaced from the third track position 3 to the fourth track position 4 and subsequently, under the influence of the biasing force $F_B$, from the fourth track position 4 to the first track position 1, without any displacement of the supporting member 20. When the user applies a sufficiently large pulling force on the second locking member 12 in the locked condition, as shown in FIG. 8, the supporting member 20 will pivot from its first position to its second position under the influence of the increased contact force between the guided element 16 and the supporting surface 19, and the guided element 16 can move from the third track position 3 directly to the first track position 1 via the fifth track portion 5A to un-lock the locking mechanism.

FIGS. 9*a*, 9*b*, 9*c*, 9*d* and 10*a*, 10*b* schematically show an example of a device according to the present invention comprising a locking mechanism according to the invention, wherein the device is a holding device 40 for a shaving apparatus 24, and in particular wherein the device is a cleaning device for cleaning a shaving head 26 of the shaving apparatus 24. In this embodiment, the holding device 40 comprises a receptacle 25 configured and arranged for accommodating the shaving head 26 of the shaving apparatus 24 when the shaving apparatus 24 is accommodated in the holding device 40, a container (not shown) configured and arranged for holding a cleaning fluid, and a supply system (not shown) configured and arranged for supplying the cleaning fluid from the container to the receptacle 25.

Figure 9:
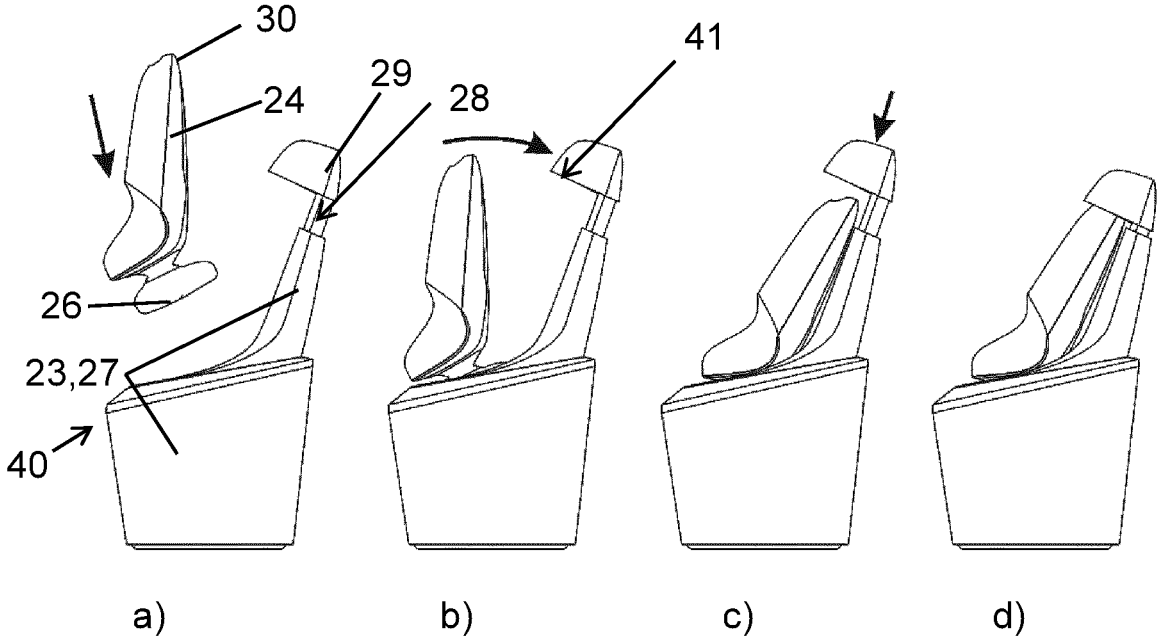
FIGS. 9*a*, 9*b*, 9*c*, 9*d* schematically show the steps of positioning of a shaving apparatus in a cleaning device according to the invention.

FIGS. 9*a*, 9*b*, 9*c*, 9*d* show the steps of arranging the shaving apparatus 24 in the holding device 40. The holding device 40 comprises a first stationary part 23, in particular a stationary holder 27 wherein the shaving apparatus 24 can be accommodated in a stationary position, and a second part 28, comprising a contact member 41, which is displaceable relative to the stationary holder 27 between a first un-locked position (shown in FIG. 9*a*) and a second locked position (shown in FIG. 9*d*) by means of a locking mechanism 13 according to the invention, which may be a locking mechanism according to any of the embodiments as described above. In the un-locked position of the second part 28, the locking mechanism 13 is in its un-locked condition, and in the locked position of the second part 28, the locking mechanism 13 is in its locked condition. The second part 28 comprises an operating member 29 by means of which a user can displace the second part 28 relative to the stationary holder 27. In the embodiment shown in FIGS. 9*a*, 9*b*, 9*c*, 9*d*, the shaving apparatus 24 is placed in the stationary holder 27 as shown in FIGS. 9*a* and 9*b*, with the second part 28 in its first un-locked position and the contact member 41 being at a distance from an end portion 30 of the shaving apparatus 24. Then an external pressing force is applied to the operating member 29 by the user, so that the contact member 41 is displaced towards the upper end 30 of the shaving apparatus 24 as shown in FIG. 9*c*. By this displacement, the contact member 41 is brought into contact with the end portion 30 of the shaving apparatus 24 as shown in FIG. 9*d* and, simultaneously, the locking mechanism 13 is brought into its locked condition. Thus, the shaving apparatus 24 is locked in the holding device 40 by a displacement of the contact member 41 between a first position associated with the un-locked condition of the locking mechanism 13, in which the contact member 41 is at a distance from the end portion 30 of the shaving apparatus 24 when the shaving apparatus 24 is accommodated in the stationary holder 27, and a second position associated with the locked condition of the locking mechanism 13, in which the contact member 41 is in contact with the end portion 30 of the shaving apparatus 24 when the shaving apparatus 24 is accommodated in the stationary holder 27. The contact member 41 may e.g. comprise electrical contacts, which are electrically connected to the shaving apparatus 24 in the second position of the contact member 41, to provide electrical power for charging a rechargeable battery of the shaving apparatus 24 and/or to provide data signals to the shaving apparatus 24.

Figure 10:
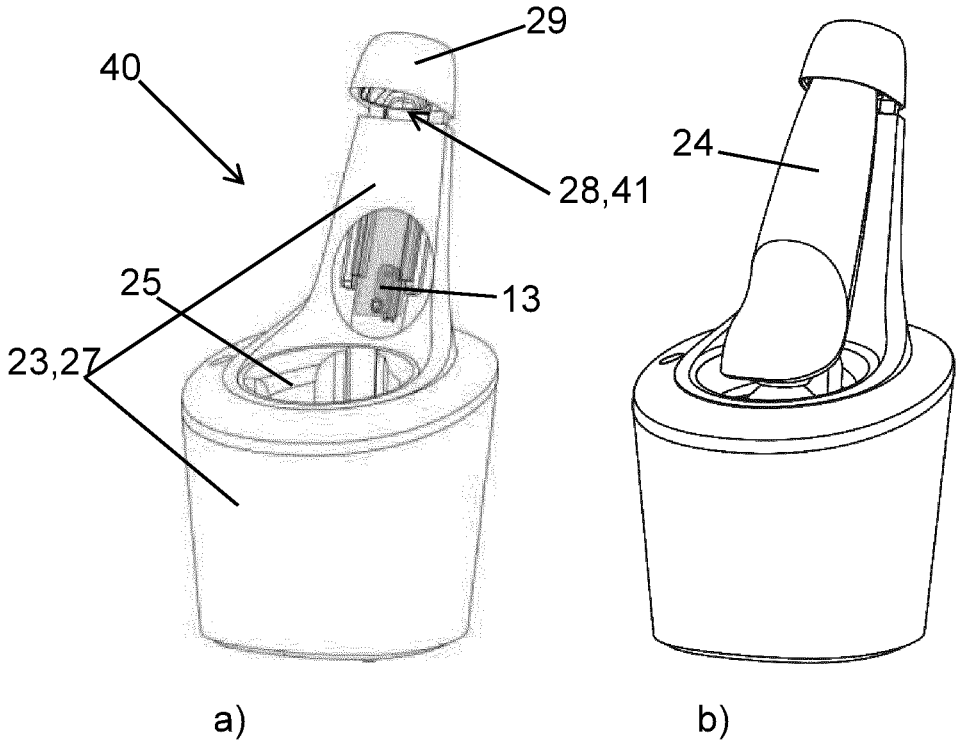
FIGS. 10*a*, 10*b* schematically show the cleaning device as shown in FIGS. 9*a*, 9*b*, 9*c*, 9*d* before and after a shaving apparatus is positioned therein.

FIG. 10*a* is a three-dimensional view of the holding device 40 before insertion of the shaving apparatus 24, and FIG. 10*b* shows the holding device 40 with the shaving apparatus 24 arranged therein and ready to have the cleaning performed.

Figure 11:
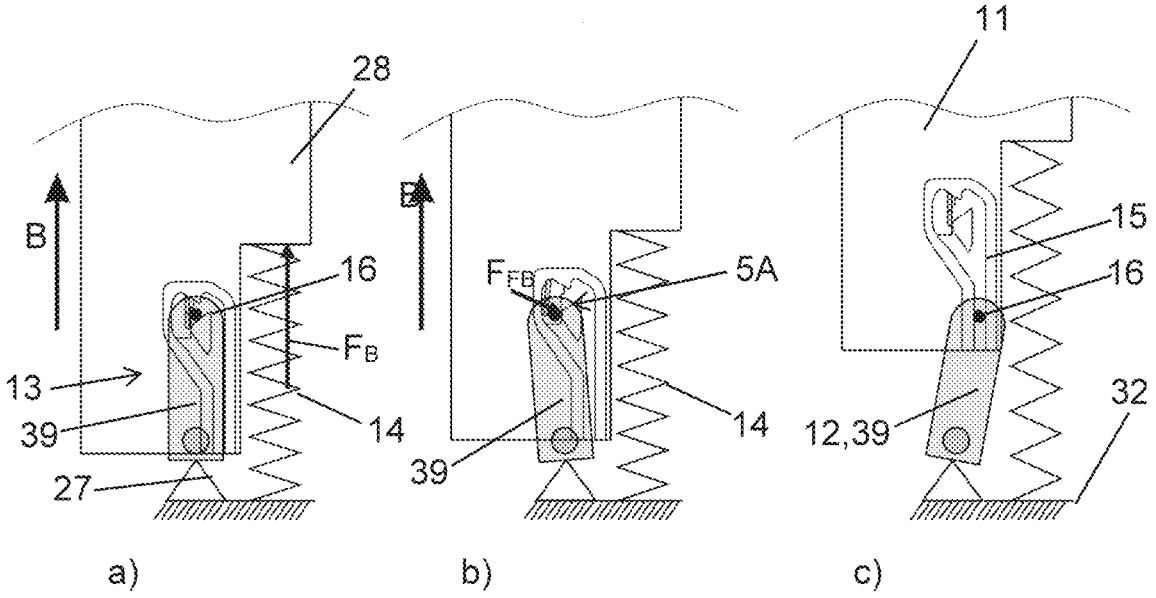

FIGS. 11*a*, 11*b*, 11*c* schematically show the locking mechanism 13 of the holding device 40 of FIGS. 10*a*, 10*b*. The stationary holder 27 of the holding device 40 and the guiding structure 32 of the locking mechanism 13 are only schematically illustrated as fixation points. In this embodiment, the first locking member 11 of the locking mechanism 13 comprising the track structure 15 is displaceable relative to the stationary holder 27 and relative to the guiding structure 32 in a direction parallel to the biasing direction B of the biasing member 14, and the biasing member 14 exerts the biasing force $F_B$ on the movable first locking member 11. The design of the schematically illustrated biasing member 14 and the arrangement thereof are not intended to be how it would look in a real product. The biasing member 14 may also be arranged at other locations within the holding device 40. The guided element 16 is provided on a carrier 39, which is hingedly connected to the guiding structure 32.

Figure 12:
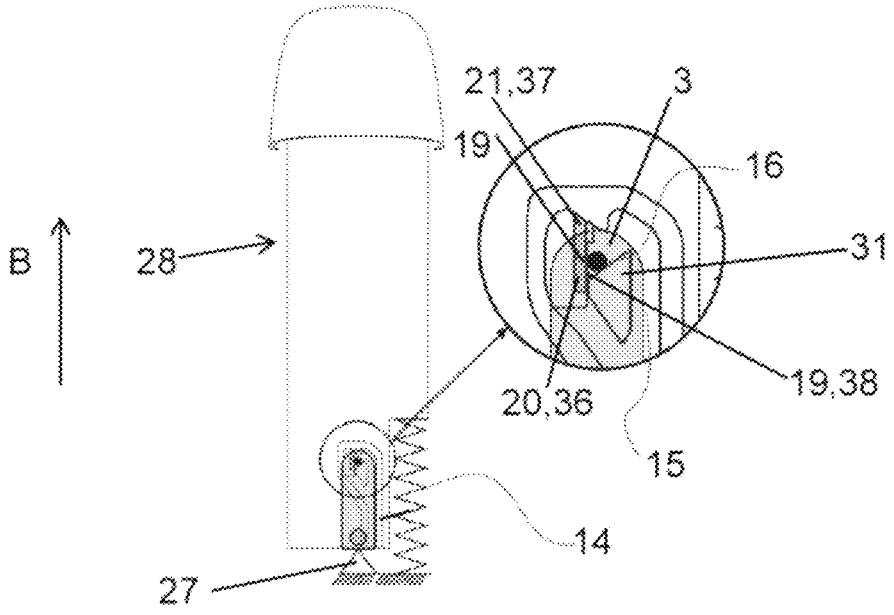
FIG. 12 schematically shows a front view of the moveable second part of the cleaning device as shown in FIGS. 9*a*, 9*b*, 9*c*, 9*d* with the locking mechanism in its locked condition.
Figure 13:
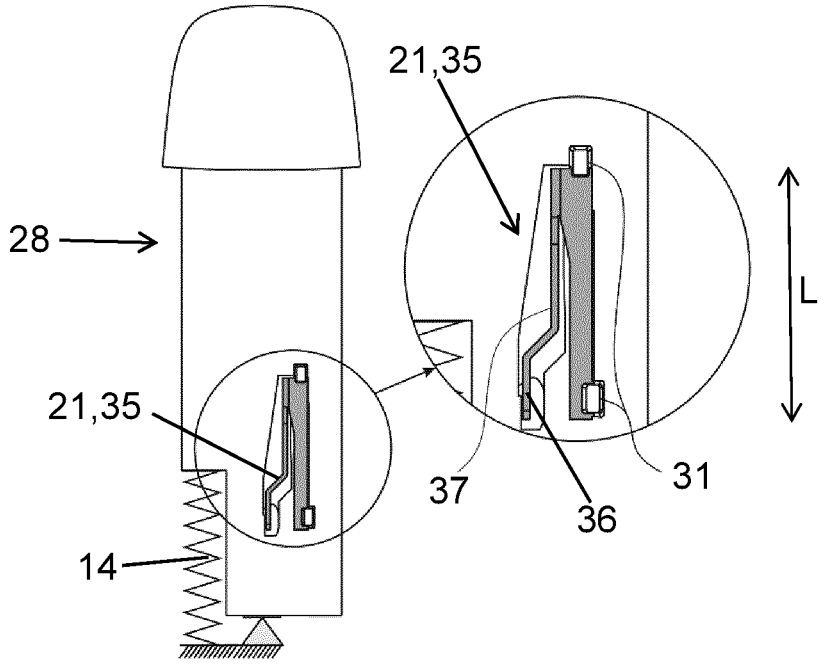
FIG. 13 schematically shows a rear view of the second part as shown in FIG. 12.
Figure 14:
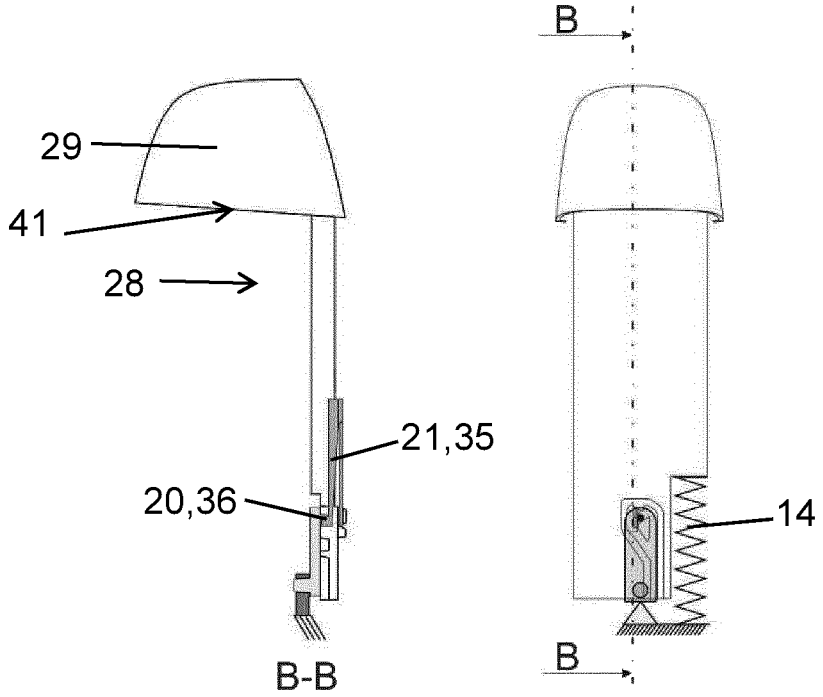
FIG. 14 schematically shows a partial cross-sectional side view of the second part as shown in FIG. 12.

The locking mechanism 13 of the holding device 40 is further illustrated in FIG. 12, which schematically shows a front view of the second part 28 of the holding device 40, in FIG. 13, which schematically shows a rear view of the second part 28, and in FIG. 14, which schematically shows a side view of the second part 28. In this embodiment, the further biasing member 21 of the locking mechanism 13 is a leaf spring 35. The leaf spring 35 has a main portion 37, which has a longitudinal extension L with a main extension component parallel to the biasing direction B. The leaf spring 35 further has an end portion 36, which protrudes relative to the main portion 37 in a direction perpendicular to an imaginary plane in which the first, second, third, fourth and fifth track portions 1A, 2A, 3A, 4A, 5A of the track structure 15 extend. Said end portion 36 constitutes the supporting member 20 of the locking mechanism 13. The supporting surface 19 of the supporting member 20 comprises a side surface 38 of said end portion 36 facing the third track position 3. As shown in FIG. 12, in the first position of the supporting member 20, the supporting surface 19 rests against an abutment member 31 of the track structure 15 under the influence of the further biasing force $F_{FB}$ provided by the leaf spring 35. Said abutment member 31 is provided near the third track position 3. FIGS. 13 and 14 show examples of how the leaf spring 35 could be mounted in the second part 28 of the holding device 40.

FIGS. 11*a* and 12 show the locking mechanism 13 in its locked condition, with the guided element 16 in the third track position 3. In the locked condition of the locking mechanism 13, the supporting member 20, formed by the protruding end portion 36 of the leaf spring 35, rests against the abutment member 31 under the influence of the further biasing force $F_{FB}$ of the leaf spring 35, and the guided element 16 rests against the abutment member 31 and against the supporting surface 19 of the supporting member 20 under the influence of the biasing force $F_B$. When, in this locked condition of the locking mechanism 13, the user applies a pushing force on the operating member 29, which is fixedly connected to the moveable first locking member 11, the guided element 16 will be displaced from the third track position 3 to the fourth track position 4 and subsequently, under the influence of the biasing force $F_B$, from the fourth track position 4 to the first track position 1, without any deflection of the leaf spring 35 and without any displacement of the supporting member 20. In particular, the guided element 16 will be displaced from the third track position 3 to the fourth track position 4 along and over the protruding end portion 36 of the leaf spring 35, and the guided element 16 will be displaced from the fourth track position to the first track position along the side surface of the protruding end portion 36 facing away from the third track position 3. When, in the locked condition of the locking mechanism 13, the user applies a sufficiently large pulling force on the operating member 29, the leaf spring 35 will be deflected under the influence of the increased contact force between the guided element 16 and the supporting surface 19, so that the supporting member 20 is displaced from its first position to its second position and the guided element 16 can move from the third track position 3 directly to the first track position 1 via the fifth track portion 5A to un-lock the locking mechanism 13. FIG. 11*b* shows the guided element 16 moving along the fifth track portion 5A, with the leaf spring 35 in its deflected condition, under the action of the external pulling force and the biasing force $F_B$ of the biasing member 14. FIG. 11*c* shows the guided element 16 back in the first track position 1.

Figure 15:
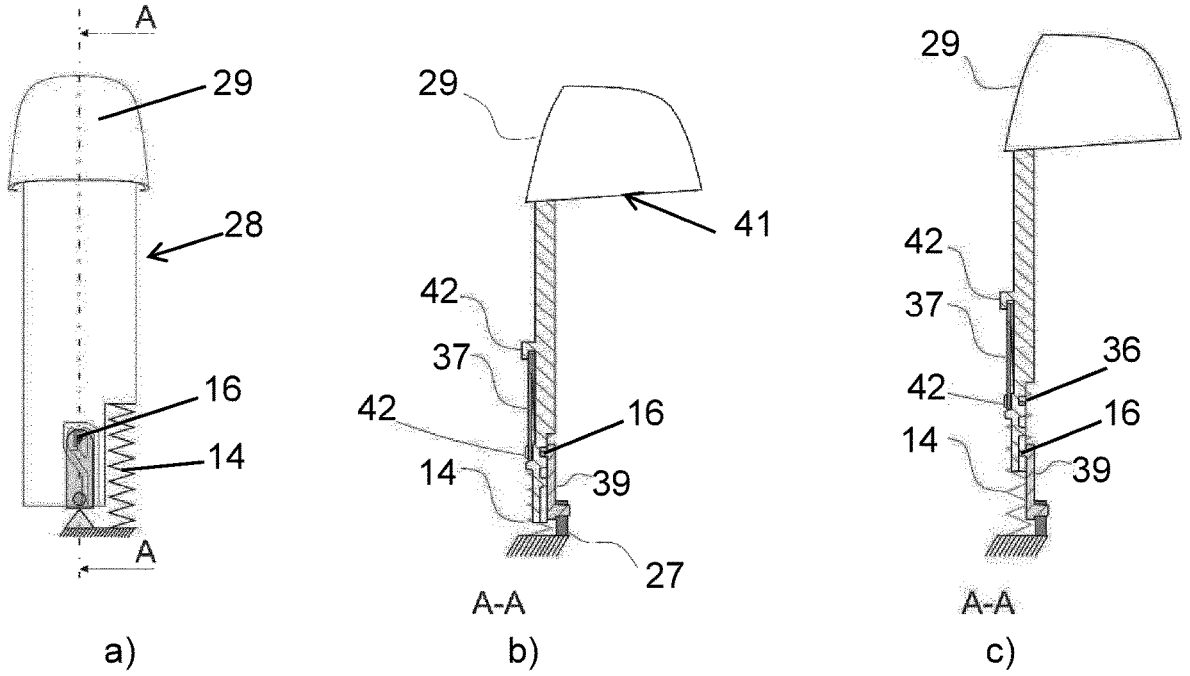

FIG. 15*a* shows the front view of the second part 28 of the holding device 40 as in FIG. 12, while FIG. 15*b* shows a cross-sectional side view of the second part 28 along the line A-A in FIG. 15*a* with the locking mechanism 13 in its locked condition, and FIG. 15*c* shows a cross-sectional side view of the second part 28 along the line A-A in FIG. 15*a* with the locking mechanism 13 in its un-locked condition. In FIGS. 15*a*, 15*b*, mounting means 42 are schematically shown by means of which the leaf spring 35, comprising the main portion 37 and the protruding end portion 36, is mounted to the second part 28 of the holding device 40.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

Any reference signs in the claims should not be construed as limiting the scope.

The invention claimed is:

1. Locking mechanism comprising a first locking member, a second locking member, a biasing member exerting, during operation, a biasing force ($F_B$) on at least the first locking member or the second locking member in a biasing direction (B), and a guiding structure for mutually guiding the first and second locking members such that the first and second locking members are mutually displaceable with at least a displacement component parallel to the biasing direction (B), wherein the first locking member comprises a track structure and the second locking member comprises a guided element guided by the track structure, wherein the track structure comprises:

a first track portion extending between a first track position and a second track position which are at a mutual distance relative to the biasing direction (B), a second track portion extending between the second track position and a third track position, said third track position being located between the first track position and the second track position relative to the biasing direction (B), a third track portion extending between the third track position and a fourth track position, said third track position being located between the first track position and the fourth track position relative to the biasing direction (B), and a fourth track portion extending between the fourth track position and the first track position, the first track position and the fourth track position being at a mutual distance relative to the biasing direction (B), wherein:

in an un-locked condition of the locking mechanism, the guided element is positioned in the first track position, to lock the locking mechanism, the guided element and the track structure are mutually displaceable such that the guided element is displaced from the first track position to the third track position by a first displacement via the first track portion against action of the biasing force ($F_B$) and by a subsequent second displacement via the second track portion under influence of the biasing force ($F_B$), in a locked condition of the locking mechanism, the guided element is positioned in the third track position and rests against a supporting surface of the track structure under influence of the biasing force ($F_B$), the biasing force ($F_B$) determining a predefined contact force ($F_C$) between the guided element and the supporting surface, to un-lock the locking mechanism, the guided element and the track structure are mutually displaceable such that the guided element is displaced from the third track position to the first track position by a third displacement via the third track portion against action of the biasing force ($F_B$) and by a subsequent fourth displacement via the fourth track portion under influence of the biasing force ($F_B$), wherein:

the supporting surface is provided on a supporting member which is displaceable relative to the track structure from a first position to a second position, with at least a displacement component perpendicular to the biasing direction (B), against action of a further biasing force ($F_{FB}$) of a further biasing member, in the first position of the supporting member, with the guided element in the third track position, the guided element rests against the supporting surface under influence of the biasing force ($F_B$), in the second position of the supporting member the track structure has a fifth track portion, extending between the third track position and the first track position, via which the guided element is displaceable from the third track position to the first track position without any mutual displacement of the guided element and the track structure against action of the biasing force ($F_B$), to un-lock the locking member, and the further biasing force ($F_{FB}$) has a predefined value such that a displacement of the supporting member from the first position to the second position under influence of a contact force between the guided element and the supporting surface only occurs when said contact force exceeds said predefined contact force ($F_C$) by a predefined threshold value.

2. Locking mechanism according to claim 1, wherein the supporting member is pivotally mounted in relation to the track structure and is pivotable from the first position to the second position against action of the further biasing force ($F_{FB}$).

3. Locking mechanism according to claim 2, wherein, in the first position of the supporting member, the supporting surface extends obliquely relative to the biasing direction (B).

4. Locking mechanism according to claim 2, wherein the guided element has a sloped surface by means of which, in the locked condition, the guided element rests against the supporting surface, said sloped surface extending obliquely relative to the biasing direction (B) in the locked condition.

5. Locking mechanism according to claim 3, wherein a pivot axis of the supporting member extends in an imaginary plane in which the first, second, third, fourth and fifth track portions extend.

6. Locking mechanism according to claim 3, wherein a pivot axis of the supporting member extends perpendicularly to an imaginary plane in which the first, second, third, fourth and fifth track portions extend.

7. Locking mechanism according to claim 1, wherein the supporting member and the further biasing member are integrally formed.

8. Locking mechanism according to claim 1, wherein the further biasing member comprises a leaf spring, and wherein the supporting member is provided on an end portion of the leaf spring which is deflectable at least with a deflection component perpendicular to the biasing direction (B).

9. Locking mechanism according to claim 8, wherein the supporting member is integrally formed with the leaf spring.

10. Locking mechanism according to claim 9, wherein the leaf spring has a main portion, which has a longitudinal extension (L) with a main extension component parallel to the biasing direction (B), and wherein the end portion of the leaf spring protrudes relative to the main portion in a direction perpendicular to an imaginary plane in which the first, second, third, fourth and fifth track portions extend, the supporting surface comprising a side surface of said end portion facing the third track position.

11. Locking mechanism according to claim 8, wherein, in the first position of the supporting member, the supporting surface rests against an abutment member of the track structure under influence of the further biasing force ($F_{FB}$), said abutment member being provided near the third track position.

12. Locking mechanism according to claim 1, wherein:

the guiding structure has a stationary position, the first locking member is displaceable relative to the guiding structure with at least said displacement component parallel to the biasing direction (B), the biasing member acts the biasing force ($F_B$) on the first locking member, and the guided element is provided on a carrier which is hingedly connected to the guiding structure.

13. Device comprising a locking mechanism a first stationary part and a second part which is displaceable relative to the first stationary part between an un-locked position and a locked position by means of the locking mechanism, said second part comprising an operating member by means of which a user can displace the second part relative to the first stationary part, wherein the locking mechanism is a locking mechanism according to claim 1, wherein the first and second locking members of the locking mechanism are respectively connected to one of the first and second parts of the device, wherein said un-locked position is associated with the un-locked condition of the locking mechanism, and wherein said locked position is associated with the locked condition of the locking mechanism.

14. Device according to claim 13, wherein the device is a holding device for a shaving apparatus, and wherein:

the first stationary part is a stationary holder wherein the shaving apparatus can be accommodated in a stationary position, the second part comprises a contact member which is displaceable relative to the stationary holder and which is configured and arranged to contact an end portion of the shaving apparatus when the shaving apparatus is accommodated in the holder, said contact member being displaceable between a first position associated with the un-locked condition of the locking mechanism, in which the contact member is at a distance from the end portion of the shaving apparatus when the shaving apparatus is accommodated in the holder, and a second position associated with the locking condition of the locking mechanism, in which the contact member is in contact with the end portion of the shaving apparatus when the shaving apparatus is accommodated in the holder.

15. Device according to claim 14, further comprising:

a receptacle configured and arranged for accommodating a shaving head of the shaving apparatus when the shaving apparatus is accommodated in the holder, a container configured and arranged for holding a cleaning fluid, and a supply system configured and arranged for supplying the cleaning fluid from the container to the receptacle.

* * * * *